United States Patent [19]

Scheffel

[11] 4,067,262

[45] Jan. 10, 1978

[54] RAILWAY TRUCK

[75] Inventor: Herbert Scheffel, Pretoria, South Africa

[73] Assignee: South African Inventions Development Corporation, Pretoria, South Africa

[21] Appl. No.: 565,888

[22] Filed: Apr. 7, 1975

[51] Int. Cl.[2] ..... B61F 3/08; B61F 5/30; B61F 5/38; B61F 5/50

[52] U.S. Cl. ..... 105/168; 105/182 R; 105/224.1

[58] Field of Search ..... 295/34; 105/165, 167, 105/168, 182 R, 218 R, 224 R, 224.1

[56] References Cited

U.S. PATENT DOCUMENTS

| | | | |
|---|---|---|---|
| 133,001 | 11/1872 | Youmans | 105/168 |
| 135,614 | 2/1873 | Youmans | 105/168 |
| 289,421 | 12/1883 | Krajewski | 105/168 |
| 325,532 | 9/1885 | Graff | 105/165 |
| 350,263 | 10/1886 | Menzies | 105/165 X |
| 383,164 | 5/1888 | Youmans | 105/165 |
| 435,918 | 9/1890 | Clark | 105/168 |
| 592,540 | 10/1897 | Ellis | 105/165 |
| 986,185 | 3/1911 | Lincoln | 105/165 |
| 986,315 | 3/1911 | Ruggles | 105/168 X |
| 1,080,620 | 12/1913 | Astrom | 105/165 |
| 1,138,357 | 5/1915 | Curwen | 105/165 |
| 1,293,628 | 2/1919 | Coda | 295/34 |
| 3,512,482 | 5/1970 | Lich | 105/224.1 |
| 3,528,374 | 9/1970 | Wickens | 105/165 X |
| 3,862,606 | 1/1975 | Scales | 105/167 |

*Primary Examiner*—L. J. Paperner
*Assistant Examiner*—Howard Beltran
*Attorney, Agent, or Firm*—Ladas, Parry, Von Gehr, Goldsmith & Deschamps

[57] ABSTRACT

A railway truck having at least one load-bearing member supported on two live axle wheelsets and including symmetrical suspension structure for damping hunting of the truck and wheelsets, the structure for each wheelset connected to bearings on the wheelset and two rods pivotally connected at each of its ends to the sub-frames for diagonally interconnecting the wheelsets to couple the yawing and lateral movements of the wheelsets. The sub-frame may be rigid to transmit moments to the wheelset or it may be a pinned structure. The suspension is said to cause inefficient gearing between the wheelsets.

17 Claims, 10 Drawing Figures

RAILWAY TRUCK

CROSS-REFERENCE TO RELATED APPLICATIONS

This application is related to my formerly co-pending application Ser. No. 415,232 filed Nov. 12, 1973, now abandoned, and U.S. application Ser. No. 702,306 filed July 2, 1976 in part as a C.I.P. of U.S. Ser. No. 415,232, now abandoned.

This invention relates to railway vehicles and in particular to suspensions for such vehicles. It is applicable to railway vehicles in which a body of superstructure is pivotally supported on bogies and also to railway vehicles in which the vehicle body is supported directly on the wheelsets, e.g. four-wheeled vehicles.

For simplicity this specification uses the term "railway truck" to mean a basic railway unit including a least one load-bearing member supported on at least two wheelsets. Thus a railway truck may be a bogie or a four-wheeled vehicle. Also in this specification the term "load-bearing member" is used to mean the body of a four-wheeled vehicle or to mean one of the frame members of a bogie.

It is an object of the invention to provide suspension structure for a railway vehicle which provides good dynamic stabilization of the vehicle while at the same time permitting the vehicle to move freely through curves.

According to the invention a railway truck includes:

a. at least one load-bearing member, b. two wheelsets each comprising a pair of wheels fast on an axle, c. bearings towards each end of each axle, d. connecting means for connecting each bearing to a load-bearing member, e. means interconnecting the wheelsets to couple the yawing movements of the wheelsets, the means comprising:

a first extension member connected to a bearing on one wheelset, an identical second extension member connected to an opposite bearing on the interconnected wheelset, and a rod pivotally connected to the free ends of the first and second extension members.

Preferably to ensure that turning movements are transmitted between interconnected wheelsets two extension members are connected to each wheelset, a beam is connected between each extension member of each wheelset to form with the extension members a sub-frame on the wheelset, and two rods, which cross each other, are diagonally connected to each of the sub-frames of the interconnected wheelsets.

The extension members may extend from each adaptor in a direction inclined relatively to the longitudinal axis of the truck. Also a line between the pivotal connection of a rod to a sub-frame and the bearings to which the subframe is connected may be inclined relatively to the longitudinal axis of the truck. The connections between each extension member and each beam and between each extension member and each bearing may be pivotal.

Figure 1:
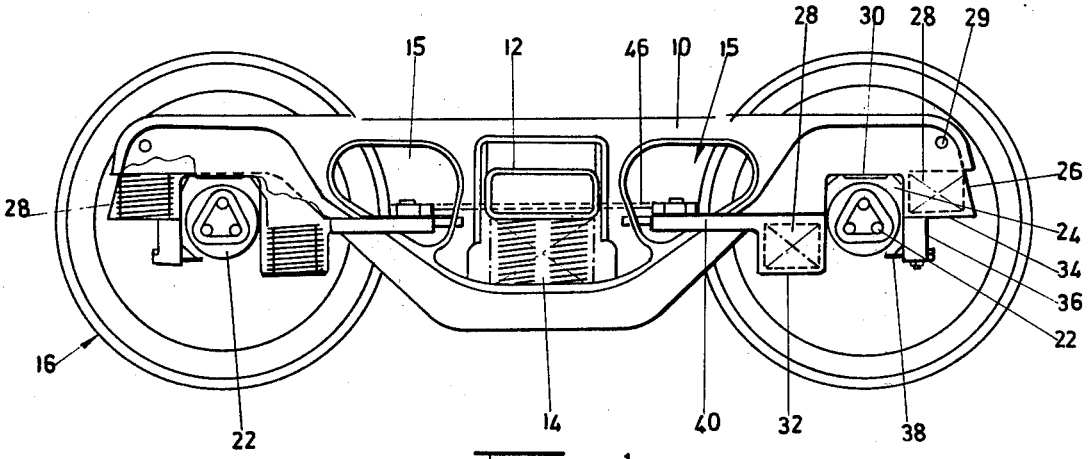
Figure 2:
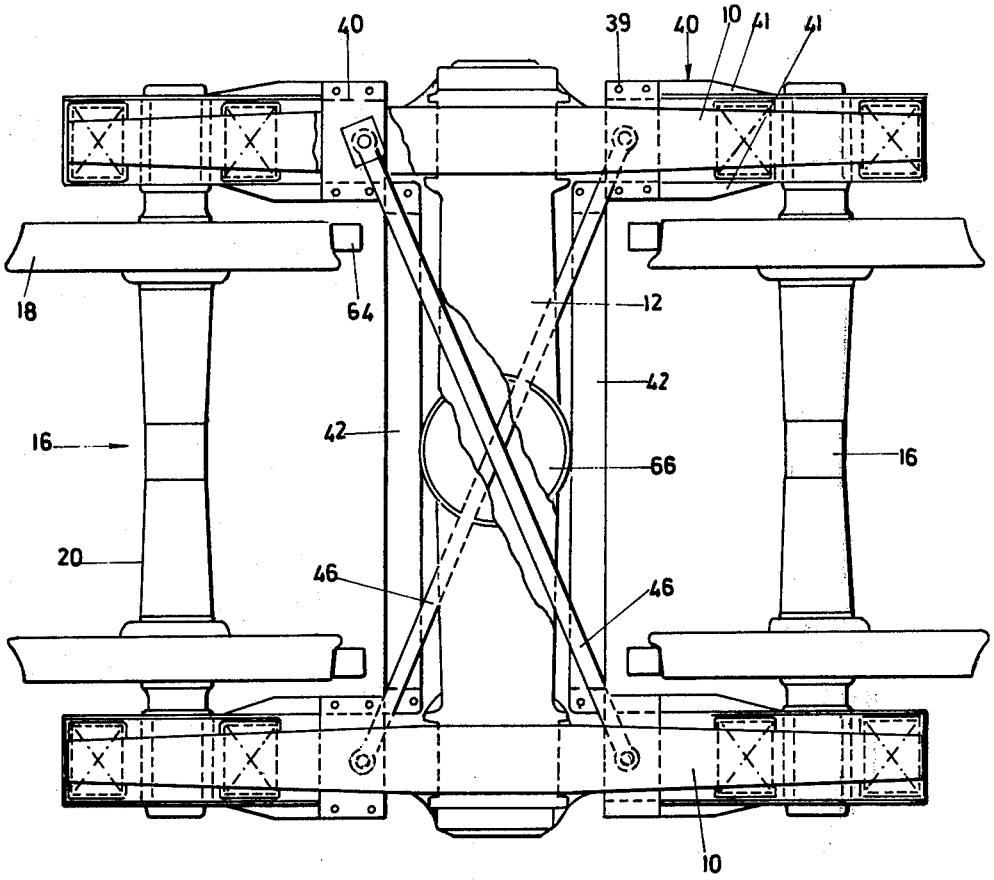
Figure 3:
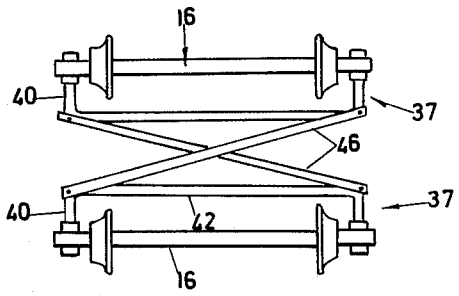
Figure 4:
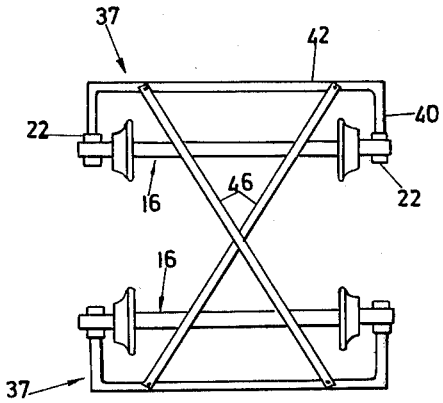
Figure 5:
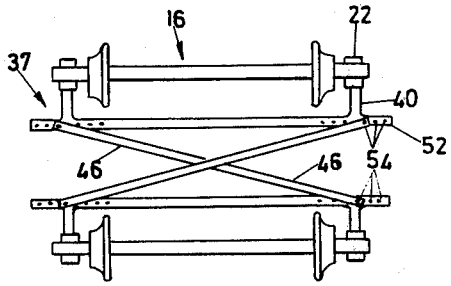
Figure 6:
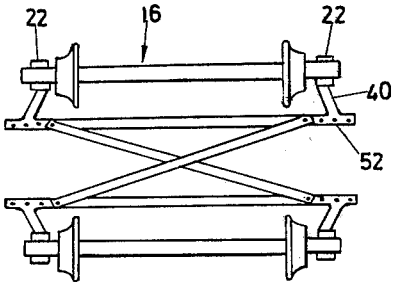
Figure 7:
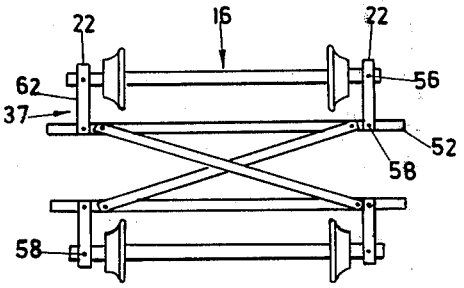
Figure 8:
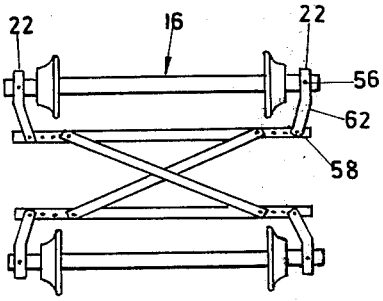
Figure 9:
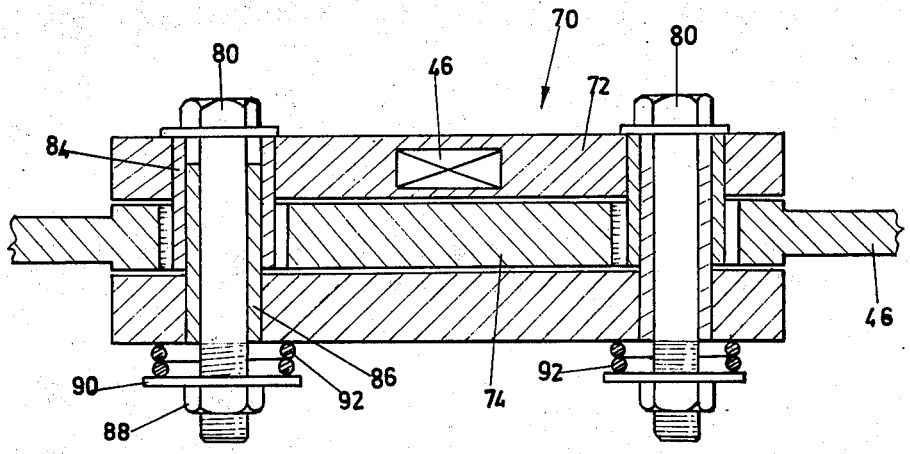
Figure 10:
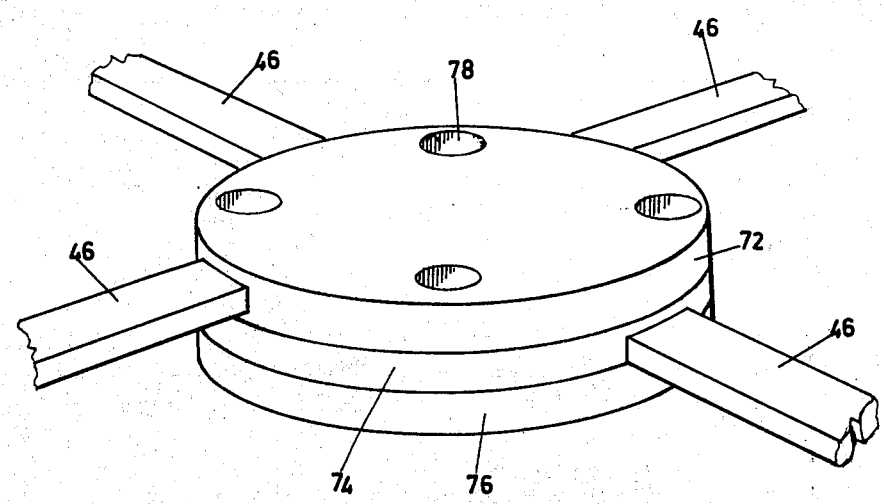

To illustrate the invention further several embodiments of railway truck constructed according to the invention are now discussed with reference to the accompanying drawings, in which:

FIG. 1 is a side elevation with parts broken away of one embodiment of the truck of the invention, FIG. 2 is a plan view of the embodiment of FIG. 1 with parts broken away for clarity, FIG. 3 is a schematic plan view of the embodiment of FIGS. 1 and 2, FIG. 4 is a schematic plan view of another embodiment of railway truck of the invention, FIG. 5 is a schematic plan view of yet another embodiment of a railway truck of the invention, FIG. 6 is a schematic plan view of yet another embodiment of the railway truck of the invention, FIG. 7 is a schematic plan view of another embodiment, FIG. 8 is a schematic plan view of a further embodiment, FIG. 9 is a side elevation in section of a means for damping two rods which cross each other relatively to each other, and FIG. 10 is a perspective view of the means of FIG. 10.

FIGS. 1 to 3 of the drawings show a three-piece bogie including two side-frames 10 and a bolster 12 supported by coil springs 14 on the side-frames 10. The bolster is essentially of a hollow, elongate box construction. The side-frames 10 rest on two wheelsets 16 each comprising a pair of wheels 18 fast or solidly mounted on an axle 20. The axle rotates in bearings 22. Each bearing 22 is connected to a side-frame 10 by a pad 24 having an arcuate lower surface which rests on the bearing 22, an adaptor 26 which rests on an upper surface of the pad 24, and two rubber sandwich elements 28 which are mounted on the adaptor 26 and which in turn support the side-frames 10. Each rubber sandwich element 28 comprises alternate layers of rubber and metal plate. The bolster has a conventional female wear plate 66 for pivotally supporting a superstructure.

Each adaptor 26 is channel shaped in cross-section and comprises a web 30 which rests on a pad 24 and two horizontal supports 32, 34 on opposed sides of the web 30 so that the supports straddle a bearing 22. A depending flange 36 is secured to the support 34 to provide a mounting for a key 38 which prevents the bearing from being separated from the adaptor 26 in the event of excessive relative vertical movement between the adaptor and bearing. A pin 29 passing through registering holes in the adaptor 26 and a relatively larger hole in the side-frame 10 is provided to hold the adaptor to the side-frame in the event of gross relative movement. The supports 32, 34 of the adaptor are equally spaced from the horizontal plane passing through the axis of the axle 20, with the support 32 being located below and the support 34 being located above the horizontal plane. This ensures that when forces are applied to the adaptor it does not rotate in a vertical plane. The pad 24 may be welded to the bearing, alternatively the pad 24 may be a snug fit between the walls of the adaptor 26 which straddle the pad 24.

When the wheelsets of the truck are interconnected by a diagonal interconnection which comprises a U-shaped extension member 40 secured to each adaptor 26, a beam 42 connected between the free ends of the extension members on a wheelset to form with the extension members a sub-frame 37 on the wheelset, and two rods, which cross each other, pivotally connected to the sub-frames 37 by pin joints 48. Each extension member comprises a plate 39, which passes through a hole 15 conventionally formed in the side-frame 10, and struts 41 which secure the plate 39 to the sides of the adaptor 26. The beam 42 is connected to the plates 39 of the extension members 40. The rods 46 pass through slots in the bolster, the slots being sufficiently wide and deep to ensure that the rods do not contact the bolster on relative movement of the rods and the bolster to one another. The beam, inter alia, acts to prevent significant convergence or divergence of the extension members when the wheelsets move longitudinally relatively to each other.

Single-acting brakes 64 are provided for each wheel. Brake beams and the like for the brakes have not been shown.

Each wheel has a profiled tread, i.e. does not have a straight taper, and the profile is such that the wheel has a high effective conicity which is greater than 1/20. The elastomeric elements 28 impose a yaw constraint on the wheelsets which is sufficiently low to permit each wheelset to attain a radial position in a curve. The relationship between the wheel tread conicities and the yaw constraints of the element 28 is such that each wheelset is substantially self-steering in the curves in which the truck is to be used. My aforesaid prior application Serial No. 415,232 in part discloses the relationship between the conicities and the yaw constraints necessary to obtain self steering.

The diagonal interconnection is resilient between the wheelsets, the elasticity being in the range from $3 \times 10^6$ N/m to $3 \times 10^7$ N/m ($1.7 \times 10^4$ to $1.7 \times 10^5$ lbf/in). This elasticity is essential for the diagonal interconnection to act as a hunting stabilizer. If sufficient elasticity cannot be obtained from the materials of the diagonal interconnection, then rubber or other types of elastomer may be provided at the pin joints.

My aforesaid prior application Ser. No. 415,232 discloses and claims a suspension for a railway truck in which the diagonal interconnection is used to obtain hunting stability even at high speeds in a truck in which the wheelsets have such high effective conicities and such low yaw constraints to allow them to be self-steering. With the structure disclosed in this earlier application Ser. No. 415,232 there are difficulties in adapting the diagonal interconnection to conventional and/or existing bogies. This invention discloses structure which is more practical in terms of total cost, manufacturing requirements and adaptation to existing or conventional bogies than the structure of the earlier application. For example the wheelsets are interconnected by rods which may be solid, tubular or any other section, which rods are simply pin-pointed to the sub-frames on the wheelsets. Each sub-frame 37 is constructed of simple-section beams 42, plates 39 and angle iron 41. The adaptors 26 are cast or formed from welded plates. These simple components should be compared with the construction of Bissell frame or anchors integral with the adaptors as shown in the aforesaid U.S. application Ser. No. 415,232. The diagonal interconnection is easily adaptable to any type of bogie having a bolster. For example the plates 39 of the extension members 40 pass through the holes 15 conventionally formed in the side-frames 10, and the rods 46 pass through slots simply cut into a conventional bolster.

In addition to the constructional advantages, the inventor has found experimentally that the diagonal interconnection of the invention provides additional hunting stabilization for a truck over that disclosed in the aforesaid U.S. application Ser. No. 415,232.

As yet, because of the complicated interaction of the elements in the interconnection, the inventor has not been able to formulate a definite theory to explain why the diagonal interconnection of the invention is so effective. One possible explanation hinges on considering the diagonal interconnection to be a gear which transmits moments and forces between the interconnection wheelsets. Thus if one wheelset oscillates or is perturbed the gear transmits the movement to the other wheelset and in so doing exerts reactive forces on both the responding and perturbed wheelsets. The definition of responding and perturbed wheelsets will alternate when both the wheelsets are oscillating.

If the mechanical efficiency of the gear for transmitting moments and forces is termed to be E, then it can be shown mathematically that the forces which tend to stabilize hunting for one wheelset will be proportional to $(1 + E)$ and for the other wheelset will be proportional to $(1 - E)$. Thus, if the efficiency is very high and approaching one, such as may be obtained with the diagonal interconnections of my aforesaid prior application Ser. No. 415,232, then it can be seen that the stabilizing force on one wheelset will be high and on the other wheelset will be minimal. If, however, the gear is made inefficient, then both wheelsets receive significant, but different stabilizing forces. This has a net stabilizing effect which is greater than when the gear is very efficient. It is believed that the forces on the wheelsets obtained through the diagonal interconnection cause stabilizing creep forces to be generated in the contact areas between the wheels and the track.

The efficiency for transmitting moments of the diagonal interconnection can be adjusted by changing the direction in which the extension members project, the inclination of the extension members to the longitudinal axis of the truck, the lengths of the extension member or the positions of the pivotal connections of the rods 46 to the sub-frames 37. In addition the efficiency can be reduced by making the pad 24 smaller than the inside cross-section of the adaptor 26 so that the adpator 26 and pad 24 can slide and rotate relatively to each other. A clearance of about 2 to 5 mm (5/64 to 1/5 inch) has been found to be sufficient. The interferring surfaces of the pad 24 and adaptor 26 should be such that they can rub against each other. The frictional force between the rubbing surfaces of the pad and adaptor is dependent on the vehicle load. With this construction the adaptor 26 can be considered to be pivotally connected to the wheelset.

Since the diagonal interconnection can now be made effective for stabilizing hunting, the elastic constraint on the wheelsets relative to the truck can be decreased to allow each wheelset greater freedom to yaw in a curve as the elastic constraints are no longer the sole means of damping wheelset hunting. The elastic constraints may even in appropriate situations, as will be appreciated by persons skilled in the art, be reduced to zero.

The efficiency of the diagonal interconnection can be tailored to "tune out" or avoid resonance like instabilities of the bogie and body mounted on the bogie.

In FIG. 4, which shows schematically a truck having a construction similar to that of FIGS. 1 to 3, but with the sub-frame 37 located outside the wheelsets of the truck.

FIGS. 5 to 9 show various constructions of diagonal interconnection which can be used for varying its mechanical efficiency for transmitting moments and forces and thus its hunting stabilizing effect on the truck.

In FIG. 5, the sub-frame 37 on each wheelset is formed by extension members 40 and a beam 52 fixed to the extension members. The beam 52 projects beyond the extension members. Holes 54 for receiving the pin of a pin joint are formed in the beam 52. The rods 46 can be pivotally joined to the beam 52 at any of the holes 54, the holes being used being symmetrical relatively to the truck.

FIG. 6 shows a variation of the diagonal interconnection of FIG. 5 in which the extension members are inclined relatively to the longitudinal axis of the truck.

In the constructions of FIGS. 3 to 6, each extension member is secured to the wheelset so that it can transmit moments to that wheelset. For this reason the beam 42 on each wheelset may be omitted without changing the effectiveness of the diagonal interconnection.

In a modification of the embodiments of FIGS. 3 to 6 the beam 42 may be pivotally connected to its extension members 40 by means of pin-joints, rivets or welding. This construction has particular advantage in the embodiments of FIGS. 3 and 4 in which the extension members 40, beams 42 and rods 46 can be interconnected by a single pin-joint or the like.

FIG. 7 shows a variation of the construction of the sub-frame 37 in which each extension member is pivotally connected at 56 to a bearing of a wheelset and is also pivotally connected at 58 to the beam 52. The pivotal connections 56 and 58 can be pin joints, rivetted joints or the like which permit a small amount of relative pivotal movement. The pivotal connection 56 is over the center of the bearing 22 so that each extension member is rotatable about a vertical axis approximately over the center of the bearing 22.

The pivotal connection 56 between each extension member 62 and its bearing 22 can be formed by making the pad 24 rotatable relatively to the adaptor 26 with the extension member secured to the adaptor. To make the pad and adaptor of FIG. 1 rotatable relatively to each other a lateral and longitudinal clearance is provided between them and suitable rubbing surfaces are provided where the adaptor rests on the pad.

In FIG. 8 there is shown a variation of the diagonal interconnection of FIG. 7. In this embodiment each extension member 62 is connected to its beam 52 in such a manner that it lies inclined relatively to the longitudinal axis of the truck. Here, if one wheel set moves laterally relatively to the other wheelset, then because of the interconnection of the sub-frames the wheelset moves, in effect, laterally relatively to its beam 52. This causes one of the extension members 62 to push the ends of the wheelset and beam closet to it away from each other and the other member 62 to pull that end of the beam and wheelset together. This forces the wheelset into a position where stabilizing creep forces are generated in the contact areas between the wheel and the track.

With either of the embodiments of FIGS. 6 and 8, the extension members can either project outwardly or inwardly of the truck as shown.

The inventor has also found that it is desirable to damp the rods 46 relatively to each other. In FIGS. 9 and 10 thre is shown a means 70 for damping the rods relatively to each other. The means 70 comprises a first plate 72 secured to one of the rods 46, a second plate 74 secured to the other of the rods 46, and a third plate 76 connected to the first plate 72 so as to interpose the second plate 74 between itself and the first plate 72. Each of the plates 72, 74 and 76 have four through-holes 78 which are in register, the holes in the second plate being of larger diameter than the holes in the first and third plates.

Bolts 80 pass through the holes. In order to ensure a good sliding fit of the bolts 80 in the holes 78 a brass or Nylon bush 84 passes through each hole in the first plate and extends towards the third plate 76. A bush 86 of smaller diameter and slidable axially in the bush 84 is inserted through the bush 84. The bush 86 is a snug fit around the bolt 80 and is connected to the plate 76. A nut 88 and washer 90 is engaged with each bolt 80 with a spring 92 being provided between the washer and the third plate 76.

In use, each nut 88 is tightened onto its bolt to compress the spring 92 and prestress the first and third plates together. The rods 46 are permitted a small amount of relative movement, both rotational and sliding, because of the large clearance holes in the second plate. Any movement is frictionally resisted by the rubbing of the second plate against the first and third plates.

A single bush may also be used in place of the telescopic bushes 84, 86. In this event the bush would be secured to the plate 72 and would be a sliding fit in the plate 76. Thus the plate 76 would be movable towards and away from the plate 72, but would be guided laterally relatively to the plate 72.

As is known hunting stability is at its worst in railway vehicles which are lightly loaded or empty. For this reason the prestress imposed by the compression of the spring 92 is selected for optimum hunting stability of the vehicle when it is lightly loaded.

In the just described embodiments the bearings 22 are located outside the wheels. The bearings may, of course, be located between the wheels of a wheelset, i.e. inboard, with the extension members still being connected to the bearings.

While it is most convenient to attach the extension members 40 to the bearing 22 which support the load-bearing members, such as side-frames of a bogie or the body of a four-wheeled vehicle, the extension members may be connected to separate bearings provided specifically for that purpose. In a vehicle in which the wheelsets are driven by an electric motor mounted on bearings on the wheelset, then the extension members may be connected to the casing of the motor.

We claim:

1. A railway truck having a longitudinal axis in its direction of travel and including:

a. at least one load-bearing member;

b. two live wheelsets each having profiled wheel treads whereby steering forces are generated on curved track;

c. a pair of axle bearings for each wheelset;

d. an adaptor seated on each bearing, each adaptor being fixed laterally and longitudinally with respect to its bearing;

e. resilient means elastically suspending each adaptor laterally and longitudinally to a load-bearing member and imposing constraints against yawing movement of the wheelsets relatively to the load-bearing member which are lower than the steering forces generated on the wheelsets on curved track whereby each wheelset is self-steering; and f. means interconnecting the wheelsets to couple yawing movements of the wheelsets in opposite senses thereby to counteract hunting of the wheelsets without interferring with their natural self-steering ability, the interconnecting means comprising a first extension member secured to an adaptor on the first wheelset, an identical second extension member secured to a diagonally opposite adaptor on the second wheelset and a rod extending diagonally across the truck pivotally connected to the free ends of the first and second extension members.

2. A railway truck as claimed in claim 1, in which each adaptor comprises a web seated on the bearing and a pair of supports depending from the web and straddling the bearing, each support presenting an upwardly facing seat for a resilient member which in turn supports a load-bearing member.

3. A railway truck having a longitudinal axis in its direction of travel and including:

a. at least one load-bearing member;

b. a pair of live axle wheelsets each equipped with a pair of bearings and each having profiled wheel treads;

c. an adaptor for each bearing;

d. load-transmitting means suspending each adaptor to a load-bearing member for low yaw constraint on the wheelsets relatively to the load-bearing member, whereby the low yaw constraint in combination with the profile of the wheel treads makes the wheelsets self-steering; and e. means interconnecting the wheelsets to couple their yawing movements in opposite senses thereby to counteract hunting of the wheelsets, the interconnecting means comprising a pair of extension members for each wheelset, each extension member being secured to an adaptor; a cross-beam connected between the extension members on each wheel-set to form with the extension members a sub-frame on the wheelset; and two rods which cross one another pivotally connected between the sub-frames of the wheelsets.

4. A railway truck as claimed in claim 3, in which each adaptor is so attached to its bearing that it cannot rotate in a horizontal plane with respect to the bearing.

5. A railway truck as claimed in claim 3, in which each adaptor in a horizontal plane with respect to its bearing.

6. A railway truck as claimed in claim 3, in which each of a pair of extension members comprises two longitudinally extending struts each strut being secured to an adaptor at one end and secured to the other strut of that pair of struts at its other end.

7. A railway truck as claimed in claim 3, in which each adaptor comprises a web seated on a bearing and a pair of supports depending from the web and straddling the bearing, each support presenting an upwardly facing seat at its lower end for supporting a load-transmitting means which in turn supports a load-bearing member.

8. A railway truck as claimed in claim 3, in which each extension member of each wheelset projects towards the other wheelset to which the wheelset is interconnected.

9. A railway truck as claimed in claim 3, in which each pivotal connection of each rod to each sub-frame is laterally offset from a line parallel to the longitudinal axis of the truck and passing through the bearings of the two wheelsets.

10. A railway truck as claimed in claim 3, in which each extension member extends from its bearing in a direction inclined sideways relatively to the longitudinal axis of the truck.

11. A railway truck as claimed in claim 3, in which for each sub-frame the cross-beam is pivotally connected to the extension members.

12. A railway truck as claimed in claim 3, including damping means acting between the rods which cross each other to damp movements of the rods relatively to each other.

13. A railway truck as claimed in claim 12, in which the damping means comprises a first element having a substantially planar surface connected to one of the rods which cross each other, a second element having a substantially planar surface connected to the other of the rods with the planar surfaces of the first and second elements frictionally coupled to each other, and means to prestress the elements against each other.

14. A radial railway truck including a pair of live axle wheelsets each equipped with a pair of axle bearings and each having profiled wheel treads whereby steering forces are generated on curved track; an adaptor for each axle bearing, each adaptor comprising a web seated on the bearing and a pair of supports depending from the web and straddling the bearing with each support presenting an upwardly facing seat for a load-transmitting member; a pair of side-frames each of which is formed with a central opening having a base wall forming a seat for supporting a bolster; load-transmitting membes supporting each side-frame on the seats of each adaptor for low yaw constraint relative movement between the wheelsets and the side-frames whereby the wheelsets can assume substantially radial positions during curving; a bolster formed with two diagonally extending clearance spaces; spring means supporting the bolster on the seats of the side-frames; an extension member extending in clearance relation to the side-frames from each adaptor towards the bolster; and cross-anchor means connected to the extension members of diagonally opposed adaptors, the cross-anchors passing freely through the diagonally extending clearance spaces in the bolster.

15. A radial railway truck as claimed in claim 14, in which each side-frame is formed with a pair of openings flanking the central opening, pairs of diagonally opposed openings being in register with one another and a clearance space formed in the bolster.

16. A radial railway truck as claimed in claim 14, in which each extension member comprises a pair of longitudinally extending struts which flank a side-frame in clearance relation, each strut being secured to an adaptor at one end and being connected by a cross-member to the other strut at its other end with the cross-member passing freely through an opening formed in the side-frame.

17. A radial railway truck as claimed in claim 14, in which the upwardly facing seats of each adaptor are vertically staggered and the side-frames are formed with a pair of downwardly facing seats towards each end, the downwardly facing seats of the side-frames being complementally staggered to the upwardly facing seats of the adaptors.

* * * * *

UNITED STATES PATENT OFFICE

CERTIFICATE OF CORRECTION

Patent No. 4,067,262 Dated January 10, 1978

Inventor(s) HERBERT SCHEFFEL

It is certified that error appears in the above-identified patent and that said Letters Patent are hereby corrected as shown below:

On frontispiece of patent insert the following after line 8, left-hand column:

(30) Foreign Application Priority Data

| | | |
|---|---|---|
| April 5, 1974 | South Africa ..... | 74/2192 |
| April 22, 1974 | South Africa ..... | 74/2546 |
| Sept. 11, 1974 | South Africa ..... | 74/5770 |

Column 7, line 39, after "adaptor" insert --is rotatable--.

Column 8, line 29, change "membes" to --member--.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*